United States Patent [19]

Ruscheweyh

[11] Patent Number: 4,514,344

[45] Date of Patent: Apr. 30, 1985

[54] APPARATUS FOR THE MIXING OF DIFFERENT STREAMS OF AIR IN A COOLING TOWER

[75] Inventor: Hans Ruscheweyh, Aachen, Fed. Rep. of Germany

[73] Assignee: Balcke-Dürr Aktiengesellschaft, Ratingen, Fed. Rep. of Germany

[21] Appl. No.: 619,697

[22] Filed: Jun. 13, 1984

Related U.S. Application Data

[63] Continuation of Ser. No. 533,625, Sep. 19, 1983, abandoned, which is a continuation of Ser. No. 158,174, Jun. 10, 1980, abandoned.

[30] Foreign Application Priority Data

Jun. 23, 1979 [DE] Fed. Rep. of Germany ..... 2925462

[51] Int. Cl.[3] ..... B01F 3/04

[52] U.S. Cl. ..... 261/159; 261/109; 261/DIG. 77; 261/DIG. 11

[58] Field of Search ..... 261/DIG. 77, DIG. 11, 261/159, 109

[56] References Cited

U.S. PATENT DOCUMENTS

| | | | |
|---|---|---|---|
| 3,846,519 | 11/1974 | Spangemacher | 261/DIG. 77 |
| 3,923,935 | 12/1975 | Cates | 261/DIG. 77 |
| 3,965,672 | 6/1976 | Stephens | 261/DIG. 77 |

FOREIGN PATENT DOCUMENTS

| | | | |
|---|---|---|---|
| 1943067 | 3/1971 | Fed. Rep. of Germany | 261/DIG. 67 |
| 2123220 | 11/1972 | Fed. Rep. of Germany | 261/DIG. 67 |
| 2911873 | 11/1980 | Fed. Rep. of Germany . | |
| 54-16748 | 2/1979 | Japan | 261/DIG. 77 |
| 418320 | 10/1934 | United Kingdom | 261/DIG. 67 |
| 418321 | 10/1934 | United Kingdom . | |
| 489918 | 8/1938 | United Kingdom | 261/DIG. 67 |
| 520574 | 4/1940 | United Kingdom . | |
| 1268169 | 3/1972 | United Kingdom . | |
| 1511703 | 5/1978 | United Kingdom . | |

OTHER PUBLICATIONS

The American College Dictionary, Random House, Apr. 1970, p. 302.

Webster's Seventh New Collegiate Dictionary, G. & C. Merriam Co., Apr. 1965, pp. 207, 610, 611.

*Primary Examiner*—Tim Miles

*Attorney, Agent, or Firm*—Martin A. Farber

[57] ABSTRACT

Apparatus for the mixing of different streams of air and particularly dry and moist streams of air, in a cooling tower. In order to obtain an effective low-loss mixing over a short flow path by simple means, eddy fields are produced by at least one cylindrical flow body arranged transversely to the direction of flow of one of the streams of air (the main air stream) in the cooling tower as a result of the burbling or separation of the flow on the sides of the body. The transverse components of the eddy fields produce an intensive mixing of the different streams of air.

6 Claims, 6 Drawing Figures

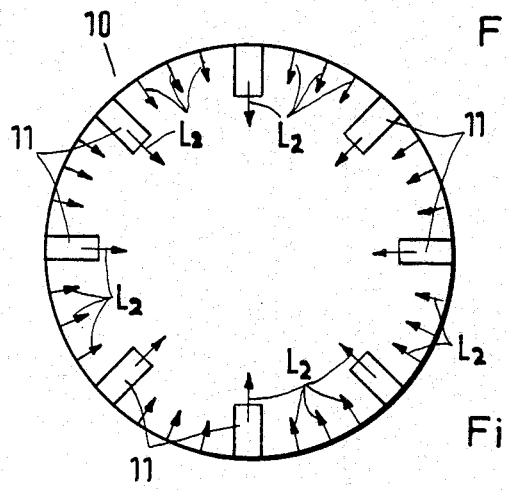
Fig. 5
Fig. 4
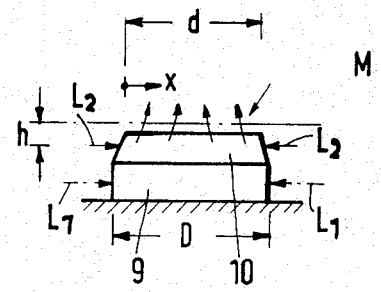
$\frac{h}{D} = 0,25$
Fig. 6
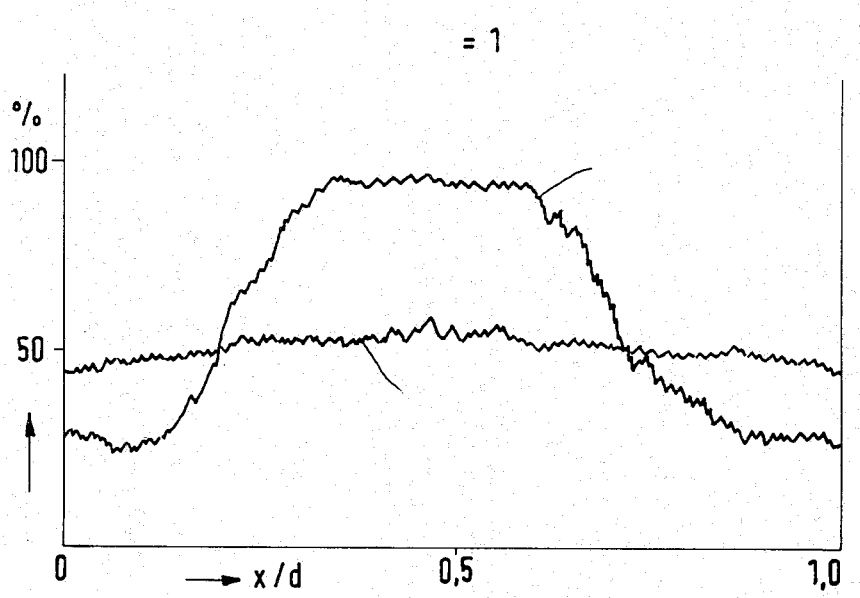

APPARATUS FOR THE MIXING OF DIFFERENT STREAMS OF AIR IN A COOLING TOWER

RELATED APPLICATION

This is a continuation of my co-pending application Ser. No. 533,625 filed Sept. 19, 1983, now abandoned, which in turn is a continuation of my application Ser. No. 158,174, filed June 10, 1980, now abandoned.

The present invention relates to a method of mixing different streams of air, and particularly dry and moist streams of air, in a cooling tower and to an apparatus for the carrying out of this method.

The mixing of different streams of air over short paths and with the smallest possible resistance to flow is important not only in wet-dry cooling towers in order to avoid the formation of vapors but also when the difference between the streams of air resides in the temperature and/or the chemical composition of the individual streams. The previously known methods and apparatus have the disadvantage that they involve a high structural expense as well as a relatively high resistance to flow.

The object of the present invention is to provide a method and an apparatus for the mixing of different streams of air which by simple means produce an effective low-loss mixing within a short flow path.

The solution for this problem provided by the method of the present invention is characterized by the fact that eddy fields are produced by at least one cylindrical flow body arranged in the cooling tower transverse to the direction of flow of one of the streams of air (main air stream) as a result of the burbling of the flow on the sides of the body, the transverse components of the eddy fields producing an intensive mixing of the different streams of air.

By the fact that the cylindrical flow body is acted on transversely to the direction of flow of the main air stream there is produced a burbling or separation of the flow on both sides of the flow body, causing the production of eddies. This burbling can take place more or less alternatingly or irregularly as a function of the Reynolds number and the cross-sectional shape. In each case there is produced a flow wake the axes of the eddies of which lie parallel or approximately parallel to the axis of the flow body the wake having strong flow components transverse to the main direction of flow. These transverse components result in an intensive mixing of the different streams of air without major flow losses occurring as a result. A good mixing is obtained over merely a relatively short path.

Although formation of the flow body as a circular cylinder gives particularly favorable mixing results, the cross section of the flow body may also be of other than circular shape, for instance elliptical, rectangular or triangular. However in this invention the flow body has a surface between its edges, the end edges defining two parallel flat congruent bases. The surface is a generated surface defined by the parallel displacement of a straight line along the end edges of the bases. The flow body of the invention can also be arranged at a certain angle to the main direction of flow.

Particularly for wet-dry cooling towers of large dimensions it is advantageous for the eddy fields, in accordance with another feature of the invention, to be produced by a plurality of cylindrical flow bodies which are arranged distributed uniformly over the circumference of the cooling tower extending in radial direction from the wall of the cooling tower. In this case good mixing is already obtained at an extremely short path which amounts to only about one-quarter of the diameter of the cooling tower.

The flow bodies need not be physically rigid structural parts, for instance pipes. They can also be formed of flow without a solid wall, namely of jets of air. Similarly, a combined arrangement of solid parts and flow parts is possible. The method of the invention is therefore furthermore characterized by the fact that the cylindrical flow bodies are in each case formed at least in part by a free jet. This free jet can be produced by a third fluid, for instance supplementary air, or else, in a further development of the invention, by individual streams of one of the streams of air to be mixed so that preferably the second stream of air itself is used to create the flow bodies of the invention.

The apparatus carrying out the method of the invention is characterized by a plurality of cylindrical air inlet tubes distributed around the circumference which are arranged in the cooling tower wall, through each of which tubes an individual stream of the stream of air to be mixed with the main air stream can be fed in radial direction to the inside of the cooling tower. The air inlet tubes are in this connection preferably distributed uniformly over the circumference but may also, within certain limits, have a different distribution. Furthermore, it is possible to make the air inlet tubes of different lengths.

When the stream of air to be introduced into the main air stream cannot be produced by natural draft it is possible, in accordance with another feature of the invention, to arrange at least one fan in each of the air inlet tubes.

In a preferred embodiment of the apparatus of the invention for a wet-dry cooling tower the air inlet tubes are arranged above the trickle-inserts of the cooling tower. The radial length of the air inlet tubes, in accordance with another feature of the invention, amounts to about 20–40% of the radius of the cooling tower so that a part of the flow bodies is formed by the free air jet which emerges from the air inlet tubes, and curves into the direction of the main flow, depending on the circumstances. The flow wake resulting from this deflection of the jet also has large transverse components of the flow which lead to a low-loss mixing within a short flow path. The ratio of the length of the air inlet tubes to their diameter is between 1.5 and 4 in accordance with the invention.

With the above and other objects and advantages in view, the present invention will become more clearly understood in connection with the detailed description of preferred embodiments, when considered with the accompanying drawings, of which:

FIG. 4 is a diagrammatic side view of a cooling tower which is developed as wet-dry cooling tower, FIG. 5 is a diagrammatic top view of the cooling tower of FIG. 4; and FIG. 6 is a graph diagram containing results of the measurement of the mixing in the measurement plane M of the two individual streams of the cooling tower of FIGS. 4 and 5, in one case without and in the other case with the air inlet tubes of the invention.

Figure 1:
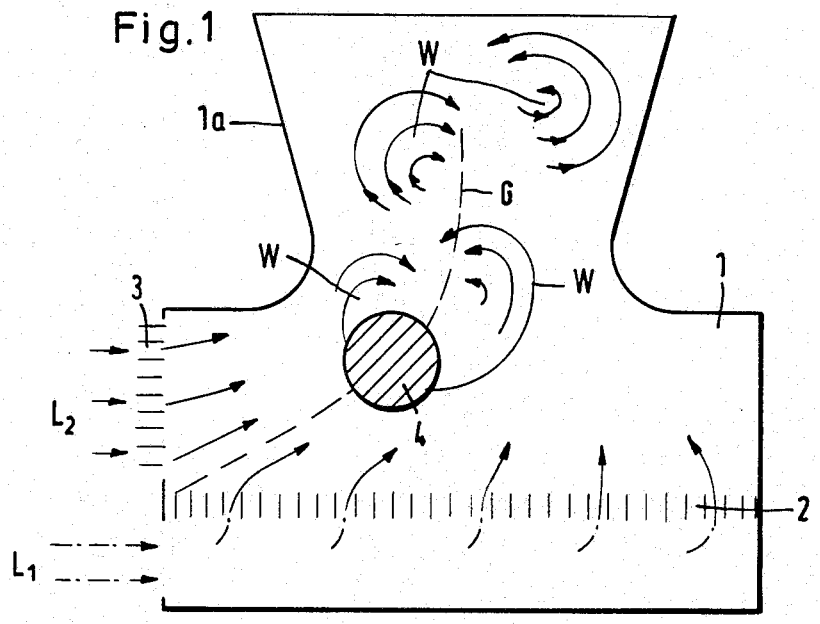
FIG. 1 is a vertical section through a first embodiment of the invention referring to a cellular-type cooler.
Figure 2:
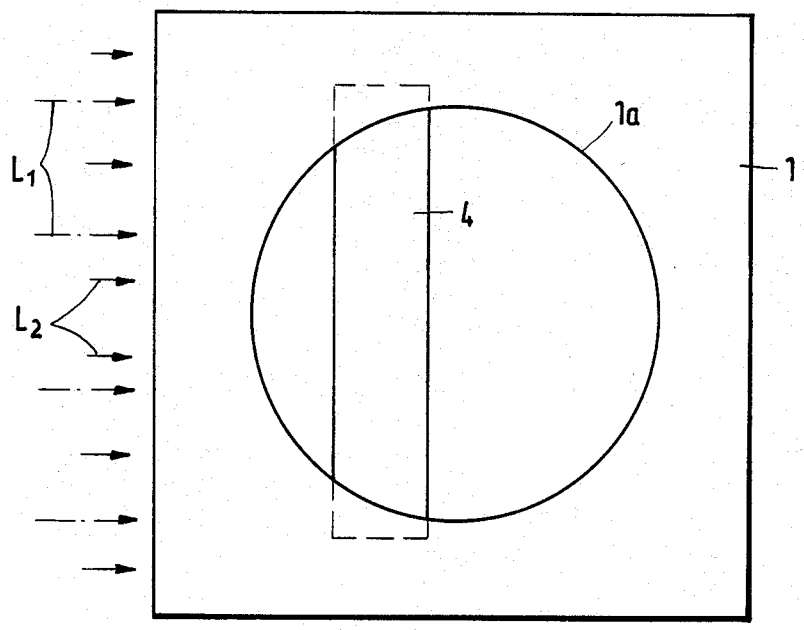
FIG. 2 is a top view of the cellular-type cooler of FIG. 1.

The cellular type cooler shown diagrammatically in FIGS. 1 and 2 has a housing 1 in whose lower part trickle inserts or water ripple plates 2 are arranged. Water is sprayed from above by a distributing device, not shown in the drawing, onto these trickle inserts 2, the water being cooled by a stream of air $L_1$. In the embodiment shown, this stream of air $L_1$ enters from one side below the trickle inserts 2 into the housing 1 of square base shape of the cellular type cooler 1, as indicated by the two lower arrows in FIG. 1. In order to mix the moist air rising out of the trickle inserts 2 with heated dry air of a second stream of air $L_2$, a heat-exchanger surface 3 is arranged within the housing 1 above the air inlet opening for the stream of air $L_1$, the stream of air $L_2$ being passed through the heat exchanger. This stream of air $L_2$ is thereby heated, as a result of which a reduction in the relative humidity of this stream of air $L_2$ takes place at the same time due to the indirect heat exchange.

As shown by the arrows in FIG. 1, the streams of air $L_1$ and $L_2$ mix with each other above the trickle inserts 2 and behind the heat exchange surface 3 in the inside of the housing 1 before the two streams of air $L_1$ and $L_2$ leave the housing 1 through a conically developed widened portion 1*a*. In FIG. 1 there is indicated in dashed line a boundary surface G which would form between the air streams $L_1$ and $L_2$ with the conditions shown in the drawing if no measures were taken within the housing 1 for the mixing of the two streams of air $L_1$ and $L_2$. In the region of this boundary surface G, however, there is arranged, in accordance with FIGS. 1 and 2, a cylindrical flow body 4 which can be noted in cross section in FIG. 1 and in top view in FIG. 2. This flow body 4 has a circular cross section in the embodiment shown although it could also be developed with an elliptical, rectangular, triangular or any other desired cross section.

By the cylindrical flow body 4 which lies transverse to the direction of flow of the stream of air $L_1$ rising from the trickle inserts 2 there are produced, in the embodiment shown in FIG. 1, alternating eddy fields W as a result of the burbling or non-laminar separation of the flow on the sides of the flow body 4. These eddy fields W have strong components of flow transverse to the main direction of flow both of the air stream $L_1$ and of the air stream $L_2$ which lead to an intensive mixing of the two air streams $L_1$ and $L_2$ without major flow losses occurring thereby. In the embodiment shown in accordance with FIGS. 1 and 2 there is thus obtained, due to the flow body 4, a low-loss mixing of the dry stream of air $L_2$ with the moist stream of air $L_1$ so that formation of vapors by the cellular type cooler as a result of locally moist streams of air is avoided. Of course, it is also possible to provide several flow bodies 4 in the cellular-type cooler of FIGS. 1 and 2. In the embodiment shown only one flow body 4 has been indicated in order to make the action thereof clearer.

Figure 3:
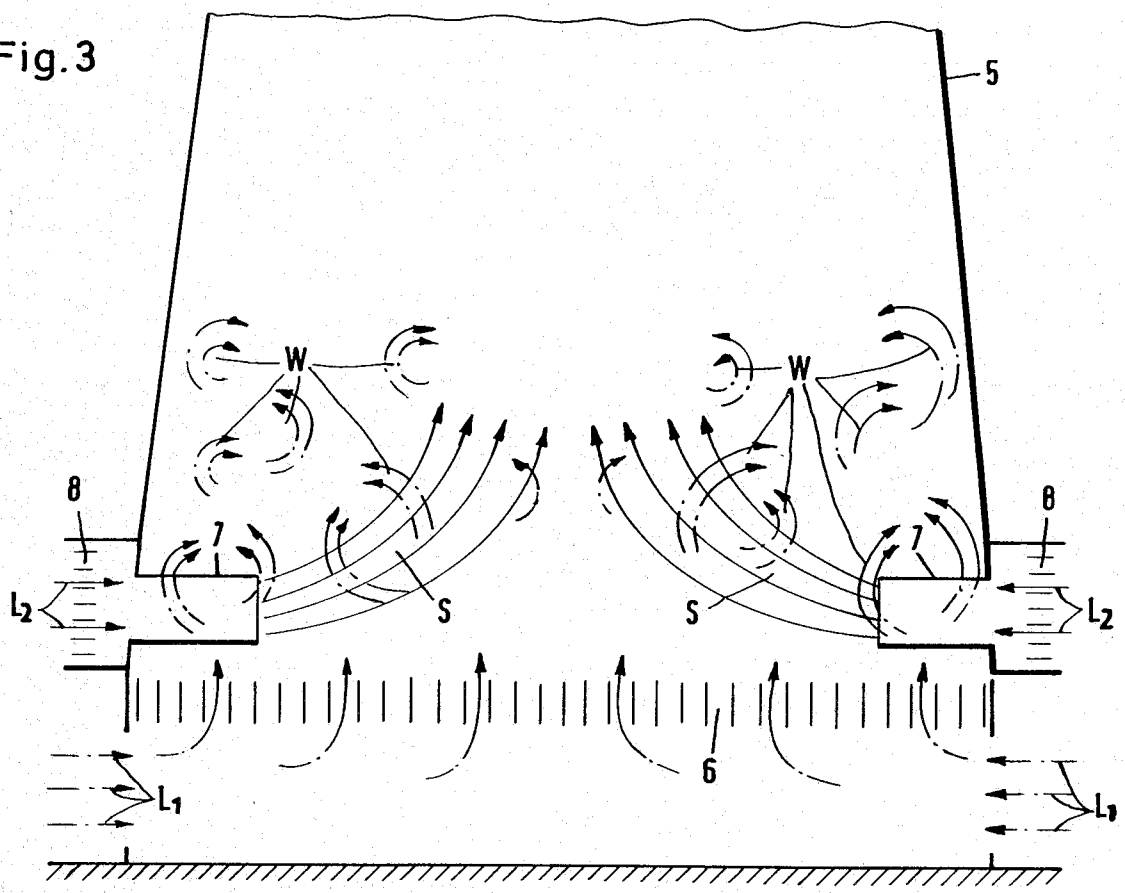
FIG. 3 is a vertical section through a second embodiment referring to a wet-dry cooling tower.

The second embodiment, shown in FIG. 3, shows a natural-draft cooling tower, developed as wet-dry cooling tower, with a cooling-tower shell 5 whose upper part has not been shown. The cooling-tower shell 5 has a circular, base contour and a conical constriction at least in its lower region. In its upper part (not shown) it can continue to extend conically or cylindrically or else have a widening. In the lower part of the cooling-tower shell 5 there are again arranged trickle inserts 6 to which the cooling air of a stream of air $L_1$ is fed from below. In the embodiment shown in FIG. 3, the stream of air $L_1$ passes over the entire circular circumference of the cooling tower shell 5 radially from the outside into the cooling tower. The incoming air collects in the region below the trickle inserts 6 and then flows—as indicated by the dash-line arrows—vertically upwardly, due to the natural draft of the cooling—tower shell 5.

Above the trickle inserts 6 there are arranged a plurality of air inlet tubes 7 which extend radially inwardly from the cooling tower shell 5. Through each of these air-inlet tubes 7 a partial stream of a second air stream $L_2$ is conducted into the inside of the cooling tower, this air stream $L_2$ having previously passed, for purposes of indirect heat exchange, through a heat-exchange surface 8, which surfaces in the embodiment shown are arranged distributed outside the cooling tower shell 5 around its circumference. If the natural draft of the cooling-tower shell is not sufficient to produce the partial streams of the air stream $L_2$, a fan, not shown in the drawing, can be arranged in front or behind each of the heat exchange surfaces 8, with respect to the direction of flow.

Both the air inlet tubes 7, which extend transversely into the vertically upwardly directed stream of air $L_1$ as well as the jets S emerging from these air inlet tubes 7 formed of partial streams of the air stream $L_2$ result on the sides thereof in burblings or non-linear separation of the air stream $L_1$ which form eddies W. These eddies W are irregular in the embodiment shown in FIG. 3. Their axes lie parallel and respectively approximately parallel to the corresponding axis of the air inlet tube, 7 and respectively the jet S emerging from same. Due to the transverse components of the eddies W there is obtained an intensive mixing of the air stream $L_2$, divided into individual partial streams, with the vertically upwardly rising air stream $L_1$ which is laden with moisture and in this way is intensively mixed with the dry air stream $L_2$. FIG. 3 shows that, despite the deflection of the jets S into the vertically upwardly extending main direction of flow, these jets S act as flow bodies, which results in a flow wake with strong flow components transverse to the main direction of flow.

The result of the flow bodies is shown for a third embodiment with reference to FIGS. 4 and 6. The cooling tower shown diagrammatically in FIG. 4 has a circular-cylindrical shell section 9 which passes upwards into a conical shell section 10. In the region of the circular-cylindrical shell section 9 the air stream $L_1$ on the entire circumference flows radially into the inside of the cooling tower. A part of the air stream $L_2$ is introduced, in the region of the conical shell section 10, through a total of eight air inlet tubes 11 which, as shown in FIG. 5, are distributed uniformly over the circumference of the cooling tower. The air stream $L_1$ is moist air while the air stream $L_2$ consists of dry air. The quantities of air of the air streams $L_1$ and $L_2$ are the same.

In FIG. 6 the concentration of the moist air of the air stream $L_1$ is plotted in vertical direction over the outlet diameter d of the cooling tower of FIG. 4, the measurement plane M being at a distance h above the air inlet tube 11 which is equal to 25% of the diameter D of the circular-cylindrical shell section 9 of the cooling tower. The diagram formed of measurement values in accordance with FIG. 6 shows that by the use of the air inlet tubes 11 in accordance with FIG. 5 an excellent mixing of the two air streams $L_1$ and $L_2$ is obtained over the entire exit surface of the cooling tower since the concentration of the moist air is slightly below or above 50% over the entire outlet diameter d. The second curve in FIG. 6 shows that without the use of the air inlet tubes 11 an approximately 100% enrichment of moist air results in the center region of the outlet flow while the annular edge zone has only a very small proportion of moisture. The air inlet tubes 11 arranged in accordance with FIG. 5 thus produce, by the eddy fields described on basis of FIG. 3, an extremely good mixing of the two air streams $L_1$ and $L_2$ within a very short flow path which amounts to only 25% of the diameter of the cooling tower. In one practical embodiment D=110 m, d=100 m, h=27.5 m, diameter of the air inlet tubes 11=7 m and length of the air inlet tubes 11=12 m, in which connection, of a total of 32 dry air feeds, only eight are formed as air inlet tubes 11.

I claim:

1. In a wet-dry cooling tower having trickle inserts in the inside of the cooling tower for the direct cooling of water charged onto said trickle inserts by a first stream of wet air vertically ascending within the cooling tower, the improvement comprising heat exchange elements for the indirect cooling of water flowing in the heat flowing in the heat exchange elements by second streams of dry air which are heated by indirect heat exchange in the heat exchange elements, means for feeding said second streams adjacent to and above the trickle inserts to the first stream of wet air in the inside of the cooling tower, said means including cylindrical air inlet tubes extending from the periphery of said cooling tower and located above the trickle inserts and radially aligned in a cross sectional plane, the latter being perpendicular to the longitudinal axis of the cooling tower, at least a part of said second streams of dry air being fed through said air inlet tubes, said tubes each have a uniform cross section throughout the length of said tubes and an effective eddy-current generating surface with respect to the first stream of air vertically ascending in the cooling tower, the radial length of said tubes is between 20 to 40% of the radius of the cooling tower, and the ratio of the length of said tubes to their diameter is between 1.5 and 4, a separate fan is operatively flow communicatingly arranged in each of said tubes, respectively, said air inlet tubes in cooperation with said fans with said at least a part of said second streams form air jets emerging from said air inlet tubes effectively extending the effective eddy-current generating surface of the latter, the tubes as well as said air jets being distributed uniformly over the circumference of the cooling tower and being perpendicularly directed towards the longitudinal axis of the cooling tower such that said air inlet tubes and said air jets both form the effective eddy-current generating surfaces transversely crossing the vertically ascending first stream of air, such that said effective eddy-current generating surfaces are acted on transversely by the first stream of air vertically ascending in the cooling tower and produce effectively across the entire radius of the cooling tower along which radius a corresponding of said tubes extends a separation of the flow of said first stream on opposite sides of said effective eddy-current generating surfaces of said air inlet tubes and said air jets, forming eddy current fields having components which extend transversely to the vertically ascending first stream, with the eddy current fields developed from said effective eddy-current generating surfaces having axes substantially parallel to the longitudinal axes of the corresponding air inlet tubes, respectively, causing an intensive mixing of said second streams of dry air with said first stream of wet air so as to make the moisture content of the streams uniform by said mixing.

2. In an apparatus for mixing of different individual streams in a cooling tower comprising in combination a plurality of flow bodies uniformly distributed over a periphery of the cooling tower, extending from a wall of the cooling tower and pointing to a central axis of the cooling tower, one of the streams being a wet single individual stream rising vertically in the cooling tower crossingly flowing on the flow bodies causing burbling of the flow on lengthwise sides of the flow bodies producing eddies, said cooling tower has a lower cylindrical portion at which said first-mentioned individual stream is fed into the cooling tower and an upwardly narrowing portion of said wall thereabove, a plurality of trickle inserts for liquid disposed in said cooling tower at a top of said lower cylindrical portion in the path of flow of said one stream rising vertically in the cooling tower for direct liquid heat exchange with said one stream, said flow bodies are cylindrical tubes arranged adjacent to and above said trickle inserts at said upwardly narrowing portion, a plurality of separate fans, at least one of said fans being operatively flow-communicatingly arranged in each of said tubes, respectively, means comprising heat exchanger surfaces peripherally arranged outside of said cooling tower upstream of and communicating with said tubes for indirect heat exchange heating of another of the individual streams by said heat exchanger surfaces, said cylindrical tubes have longitudinal axes disposed in substantially a single plane which perpendicularly intersects said central axis of the cooling tower, the radial length of said tubes is between 20% to 40% of the radius of the cooling tower, and said tubes have a ratio of the length of said tubes to their diameter between 1.5 and 4, each of said tubes have a uniform cross section throughout the length of said tubes and an effective eddy-current generating surface with respect to said vertically rising single individual stream and radially directed in said cooling tower with free ends facing but each spaced apart from the central axis of the cooling tower by at least 60% of the radius of the cooling tower thereat and constitute means for feeding a dry stream constituting said another of the individual streams through said tubes radially to the interior of the cooling tower and in cooperation with said fans for forming bundled free jets of said another individual stream emerging from the tubes for effectively extending said effective eddy-current generating surfaces of the respective tubes, said another stream being partially further fed into said cooling tower at said upwardly narrowing portion of said wall between said tubes, such that said effective eddy-current generating surfaces of said tubes and said jets define lengthwise sides causing the burbling of the flow of said first-mentioned individual stream rising in the cooling tower on said lengthwise sides forming eddy current fields of eddies throughout the entire cross-section of the cooling tower having flow components transverse to the vertical, with the eddy current fields developed from said effective eddy-current generating surfaces having axes substantially parallel to the longitudinal axes of the corresponding tubes, respectively, intensively mixing said first-mentioned individual stream and said another individual stream, such that an essentially uniform mixture of said streams over the entire cross-section of said cooling tower is obtained at a distance thereabove, said distance being 25% of the diameter of the cylindrical portion of the cooling tower.

3. The apparatus according to claim 2, wherein said tubes are air inlet tubes.

4. The apparatus according to claim 2, wherein only eight of said tubes are provided and an additional 24 feeds are positioned between and adjacent said tubes in the same plane as said tubes for said partial further feeding of said another stream.

5. The apparatus according to claim 2, wherein the quantities of the first-mentioned stream and said another stream are the same.

6. The apparatus according to claim 2, wherein said first-mentioned stream is fed over an entire circular circumference portion of the lower cylindrical portion of the cooling tower radially from the outside, collecting below the trickle inserts and then flowing vertically upwardly.

* * * * *